US009096971B2

(12) United States Patent
van der Laan

(10) Patent No.: US 9,096,971 B2
(45) Date of Patent: Aug. 4, 2015

(54) GARMENT HOLDING DEVICE

(75) Inventor: Teun Kornelis van der Laan, Amsterdam (NL)

(73) Assignee: Makinori Lifestyle B.V., Vught (NL)

( * ) Notice: Subject to any disclaimer, the term of this patent is extended or adjusted under 35 U.S.C. 154(b) by 0 days.

(21) Appl. No.: 14/006,832

(22) PCT Filed: Mar. 25, 2011

(86) PCT No.: PCT/NL2011/050208
§ 371 (c)(1),
(2), (4) Date: Nov. 18, 2013

(87) PCT Pub. No.: WO2012/134267
PCT Pub. Date: Oct. 4, 2012

(65) Prior Publication Data

US 2014/0061258 A1 Mar. 6, 2014

(51) Int. Cl.

| | |
|---|---|
| ***D06F 89/02*** | (2006.01) |
| ***D06F 73/00*** | (2006.01) |
| ***A45C 3/00*** | (2006.01) |
| *B65D 85/18* | (2006.01) |

(52) U.S. Cl.
CPC ..... *D06F 73/00* (2013.01); *A45C 3/004* (2013.01)

(58) Field of Classification Search
CPC ..... D06F 89/02; B65D 85/18; B65D 85/182; B65D 85/185
USPC ..... 224/927; 190/107, 108, 20, 13 R, 124, 190/125; 206/225, 278, 279, 289, 291, 292, 206/293, 226, 284, 286–287.1, 300; 229/87.15; 223/52, 37, 38, 84, 85
See application file for complete search history.

(56) References Cited

U.S. PATENT DOCUMENTS

| | | | | | |
|---|---|---|---|---|---|
| 374,281 | A | * | 12/1887 | Voorhees | 229/87.15 |
| 2,261,291 | A | * | 11/1941 | Salavsky | 190/113 |
| 2,362,807 | A | * | 11/1944 | Dresner | 206/289 |
| 2,423,297 | A | * | 7/1947 | Creamer | 206/279 |
| 2,502,033 | A | * | 3/1950 | Bohn | 206/293 |
| 4,598,803 | A | * | 7/1986 | Ghiassi | 190/108 |
| 4,753,329 | A | * | 6/1988 | Choy | 190/111 |
| 5,624,026 | A | | 4/1997 | Chernoff | |
| 6,499,590 | B1 | | 12/2002 | Godshaw et al. | |
| 7,134,535 | B1 | * | 11/2006 | Horvat | 190/20 |
| 8,453,896 | B1 | * | 6/2013 | Mansell | 224/576 |
| 2004/0016657 | A1 | | 1/2004 | Glaser et al. | |
| 2014/0158564 | A1 | * | 6/2014 | Blasingame | 206/287.1 |

FOREIGN PATENT DOCUMENTS

| | | | |
|---|---|---|---|
| JP | S62-152980 | U | 9/1987 |
| JP | H04-144514 | A | 5/1992 |
| JP | H05-061087 | U | 8/1993 |
| JP | 3073459 | U | 11/2000 |

* cited by examiner

*Primary Examiner* — Ismael Izaguirre
(74) *Attorney, Agent, or Firm* — The Webb Law Firm

(57) ABSTRACT

A garment holding device comprises a main sheet of material rollable in a rolling direction and at least one cloth attachment means attached to said main sheet, wherein the main sheet is provided with at least two elongated elevated zones on the front side of the main sheet, essentially mutually parallel arranged at or near the edges of said main sheet and parallel to said rolling direction. The main sheet maybe bendable at a plurality of bending lines, each bending line being arranged essentially perpendicular to said rolling direction, or it may be continuously bendable.

15 Claims, 3 Drawing Sheets

GARMENT HOLDING DEVICE

BACKGROUND OF THE INVENTION

1. Field of the Invention

The present invention relates to a garment holding device according to the preamble of claim 1.

2. Description of Related Art

Such devices are known, and serve to store and/or transport garments, such as suits and dresses or gowns. Their advantage is that they enable compact storage and transport and convenient handling of the garments.

The U.S. Pat. No. 5,624,026 issued Mar. 20, 1995 discloses a garment holding device for use with various types of luggage comprising a substantially cylindrical hollow tube about which suits and other garments can be completely wrapped, a fabric cover for holding garments securely about the outer surface of the tube, and a flexible hanger which is capable of holding suits and other garments against the outside of the tube while being flexible enough to conform to the curvature of the tube. A fabric cover wraps around the garments and the tube and holds the garments securely against the outer surface of the tube. Because the garments will be rolled instead of folded over 180 degrees, wrinkling of the garments will be reduced. The hollow center of the cylinder is utilized to carry bulky and awkward shaped objects such as shoes. The way the suits and garments are wrapped around the outside of a cylinder allows the luggage to be compact and easy to carry. Additionally, the garments no longer have to be folded and incur wrinkling, but can be gently wrapped around the outside of the cylinder. This product is available on the market under the tradename Skyroller®.

Although the known device of U.S. Pat. No. 5,624,026 is an improvement over traditional garment holders that require a suit and other clothes to be folded into two halves or more parts, which almost certainly results in wrinkling of the respective piece of garment and is not compact, the known device still suffers from the disadvantage that it causes wrinkling of the suit or other garment transported and/or stored. Therefore it is a goal of the present invention to provide an improved garment holding device, in particular a garment holding device that prevents wrinkling, while maintaining the compactness of the known device described in U.S. Pat. No. 5,624,026.

SUMMARY OF THE INVENTION

This goal is realized by a garment holding device having a main sheet which is provided with at least two elongated elevated zones on the front side of the main sheet, essentially mutually parallel arranged at or near the edges of said main sheet and parallel to said rolling direction, a curved spacing is created in for one or more suits, or another garment. In this spacing, the garment is held without substantial forces being exerted thereto and without sharp bends. As a result, the garment is much less likely to wrinkle or crease than garments in the known garment holding devices, such as that of U.S. Pat. No. 5,624,026 described above.

Another advantage of the device according to the invention is that it facilitates in making the rolled device that holds the garment closed for dust, water, etc. and therefore it facilitates a better protection of the garment(s) in the rolled device.

In an embodiment of the invention, the main sheet is bendable at a plurality of bending lines, each bending line being arranged essentially perpendicular to said rolling direction. This allows for a segmented construction of the main sheet, and for a well-defined rolling path.

In another embodiment of the invention, the bending lines are positioned at such mutual distances along said rolling direction that, when the main sheet is being rolled up, a hexagonal prismatic rod is formed. The hexagonal shape is a preferable combination of compactness, convenience in handling, and the presence of segmented sheets; the latter allows for a high bending stiffness and thus a high degree of protection for the garments in the device against forces from the outside of the device.

In a further embodiment of the invention, the main sheet is continuously bendable in the rolling direction. This embodiment offers a simple construction and very reduced folding of the garments, hence good anti-creasing effect.

In another embodiment, the main sheet has, in a direction perpendicular to the rolling direction, over at least a part of its length in the rolling direction, a rigidity sufficiently high to take up an external radial point load of 25-35 N on the outside of the main sheet when said main sheet is in a rolled up state, without deformation of more than 10 mm of each point on the surface area. Due to these measures, the device may be handled in normal traveling circumstances, such as occur when taking an airplane, without having to worry about the garments being pressed together and being wrinkled or creased. For instance, a suitcase of 23 kg, as is commonly used in airplane travel, may rest with a corner on the device according to the invention. These features may be realized in a main sheet of a single layer material as well as a multi-layered material of which at least a single layer is relatively rigid.

In yet another embodiment, the aforementioned rigidity is sufficiently high to take up an external radial load of 210-270 N equally distributed over a surface area that spans the outside length of the main sheet when said main sheet is in a rolled up state, without deformation of more than 10 mm of each point on the surface area. This allows for somewhat rougher handling of the device, e.g. by putting some other luggage on it, such as a suitcase.

In another embodiment, the main sheet is provided with at least two relief zones on the back side of the main sheet, at locations opposing said at least two elongated zones on the front side of the main sheet, which relief zones cooperate during the rolling up with the at least two elongated zones in guiding said rolling up. In this manner, the main sheet is guided by the relief zones and the elongated zones in cooperation, in order to provide more convenient rolling up.

In particular, at least one of the elongated elevated zones and its accompanying relief zone may have cross-sectional shapes with at least one protrusion respectively scoring, or vice versa, wherein the scoring is suited to accommodate said protrusion. This promotes the guidance of rolling up to a higher degree.

In another embodiment at least one of the elongated elevated zones and relief zones is provided with recesses in the direction perpendicular to the direction of rolling, for example V-shaped or rectangular shaped. The recesses may have various shapes, and sizes. In combination with sizes and shapes of the elongated elevated zones, the rolling up occurs in segments, i.e., into a prismatic rod with a number of sides.

In a further embodiment of the device, at least one of the elongated elevated zones and relief zones is inflatable. This allows for a more compact storage and transport when the device is not in use, i.e., when it holds no garments.

Preferably, the at least one cloth attachment means is a clothes hanger, wherein the clothes hanger is flexible in the direction of rolling of the device; this allows for more compact rolling. We note that the term “clothes hanger” is to be interpreted in a wide sense, including anything attached to the main sheet that is suitable for carrying garments in or at the device.

In an embodiment, the device comprises a hook suitable for carrying the device in unrolled shape, wherein the hook is integrated with or attached to a clothes hanger. As such, it becomes possible to use the hook for hanging the device at a fixed location, e.g. in a hotel or at home, while meanwhile utilizing the clothes hanger—carried by the hook—for hanging clothes against the unrolled main sheet.

Another embodiment has two clothes hangers attached to the front side of the main sheet, and a folding line in the main sheet between and parallel to said two clothes hangers as well as a hook attached to the main sheet between said two clothes hangers or to a clothes hanger. With this embodiment, it becomes possible to fold the main sheet into two parts, with their backsides against each other, one clothes hanger on each main sheet front side. The hook then serves to hang the device at a cupboard, a stand, or the like. Each clothes hanger then may carry a piece of clothing. When such a device is to be transported, it may easily be straightened with the two pieces of clothing in it, and then be rolled up.

In a further embodiment, the main sheet has a covering sheet attached to it, which covering sheet is suited to cover at least part of the front side of the main sheet and to uncover the main sheet by folding away the covering sheet. Such a covering sheet is suited either separate two pieces of clothing, to further prevent them from wrinkling or creasing when they are being rolled up in the main sheet, or to cover a single piece of clothing before it is being rolled up, which also has an aesthetical function.

In a further embodiment, each of the elongated elevated zones of the main sheet has a higher elongated part and a lower elongated part, wherein each higher part faces the edge to which it is closest, and, when the covering sheet is covering the main sheet, it is positioned over the lower parts of the elongated elevated zones of the main sheet. This has as an advantage that two pieces of clothing fit in the device, each in its own compartment, meanwhile having a compact device. Relief zones may lie over the lower elongated parts when the device is in the rolled up state, for convenient guidance in rolling up.

BRIEF DESCRIPTION OF THE DRAWINGS

The invention will now be clarified on the basis of a preferred embodiment, referring to the accompanying drawings and solely as an illustration of the invention and not in limitation thereof. In the drawings.

DESCRIPTION OF THE INVENTION

Figure 1A:
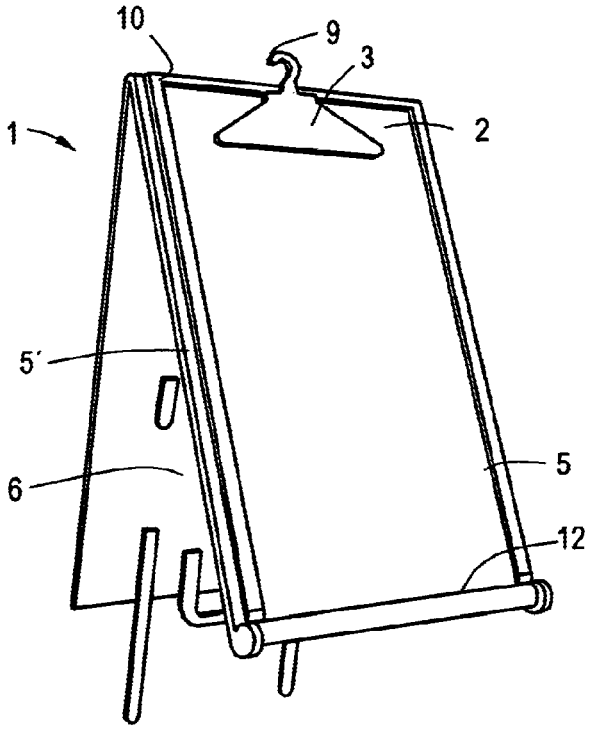
FIGS. 1*a* and 1*b* show a first embodiment of the invention, respectively in a folded state for hanging, and an elongated state for packing and unpacking.
Figure 1B:
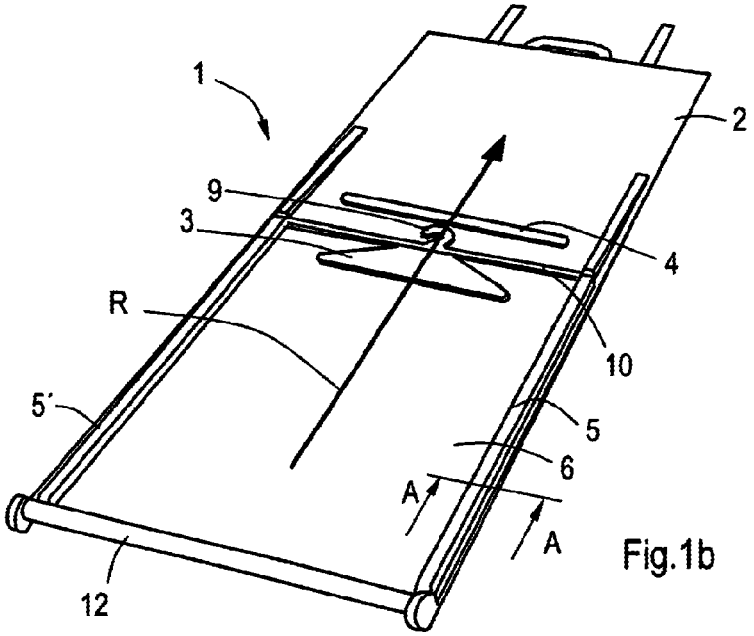

In FIGS. 1*a* and 1*b*, a garment holding device 1 comprises a main sheet 2 of material rollable in a rolling direction R, indicated by an arrow in FIG. 1*b*. Attached to the main sheet 2 are two cloth attachment means in the shape of a clothes hanger 3 and a trouser holder 4.

The main sheet 2 is provided with two elongated elevated zones 5, 5' on the front side of the main sheet (top side in FIG. 1*b*), mutually parallel arranged close to the edges of the main sheet 2 and parallel to the rolling direction R, and at a mutual distance of approximately 60 cm.

The main sheet 2 is continuously bendable over its entire length in the direction R. Alternatively, but not shown, it could be provided with stiff parts and a number, for example five, bending lines, each arranged perpendicular to the rolling direction R.

Figure 4:
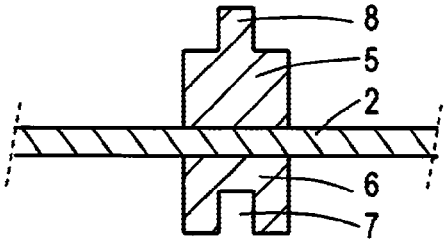
FIG. 4 shows the cross-section A-A of part of the first embodiment.

The main sheet 2 is provided with at least two relief zones 6, 6' on the back side of the main sheet, at locations opposing said at least two elevated zones 5, 5' on the front side of the main sheet In FIG. 4, a part of the embodiment shown in FIG. 1 is shown in cross-section. Here, the main sheet 2 is visible and the elevated zone 5 on the front side thereof, as well as the relief zone 6 at the rear side of the main sheet. The relief zone 6 is in shape complementary to that of the elevated zone 5, and has a recess 7 that cooperates with peak 8. These measures have as a result that the relief zone 6 cooperates during the rolling up with the elongated elevated zone 5 in guiding said rolling up. The same holds, mutatis mutandis, for the zones 5' and 6'.

It is noted that the elevated zones 5, 5' and the relief zones 6, 6' extend along a large part of the length of the main sheet 2, in this embodiment. They are left away only in the zone that is rolled up as last zone, and that serves are a cover of the device. It is not shown, but the main sheet 2 is (see FIG. 1*b*) at its rear side provided with stiffening material, providing it a high rigidity in a direction perpendicular to the rolling direction, in order to provide the device in its rolled up state, possibly with garments in it, with sufficient strength on its outside area to be able to withstand normal handling during transportation, such as carrying the device in busses, airports, airplanes and cars, etc, without substantially deforming and thereby wrinkling or otherwise damaging the clothes rolled up inside the device.

The clothes hanger 3 may hold suits, but of course may also carry a dress, including a ceremonial dress, or any other piece of clothing. Similarly, the trouser holder 4 may hold other things than trousers. The clothes hanger 3 is made of foam with rods inserted in it, in the lateral direction (R being the longitudinal direction), in order to provide it with sufficient stiffness and strength and meanwhile maintaining the flexibility necessary to allow the main sheet 2 to bend and be rolled up.

Further, the clothes hanger 3 is integrated with a hook 9, by which hook 9 the device can be varied in unrolled shape; in this manner it may be hung on a cupboard or a stand (not shown).

The clothes hanger 3 and the trouser holder 4 are both attached to the front side of the main sheet 2, and a folding line coinciding with the edge 10 in the main sheet 2 is located between and parallel to the clothes hanger 3 and the trouser holder 4. An opening (not shown) in the main sheet 2 allows the hook 9 to reach outside when the main sheet is in the rolled state; in this manner it becomes possible for a person to carry the device in its rolled state by the hook, or to hang it by the hook.

Not discussed into detail, but present, are various straps and grips for securing the device in its rolled up state respectively for carrying the device in that state, either as a horizontal or vertical roll. Both positions may be beneficial, depending on the circumstances or environment.

In particular a shoulder strap is mentioned (but not shown), attached to or near the ends of the device in its rolled state, and long enough to enable a person to carry the device conveniently by putting the strap over her shoulder, while the rolled up device hangs horizontally are hip-height or approximately that height.

A tube 13 is present at the end of the main sheet 2 where rolling is started. Such a tube is convenient for rolling up with a larger radius, with as a result an even smaller risk of wrinkling of the garments. The tube, when given a larger volume, may also be convenient for holding objects, such as a tie or shoes, in it.

Figure 2:
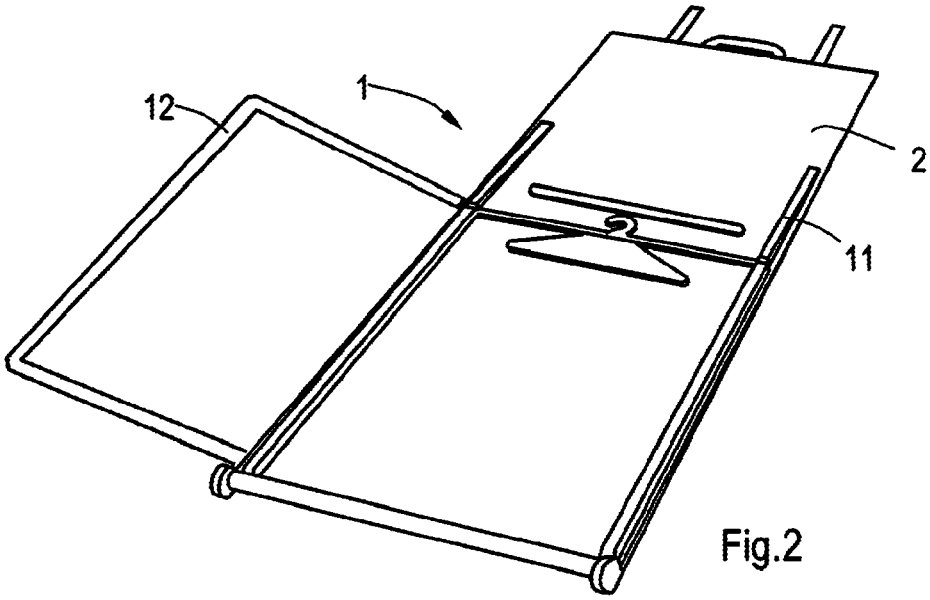
FIG. 2 shows a second embodiment of the invention, similar to the first embodiment but provided with a flap.
Figure 3:
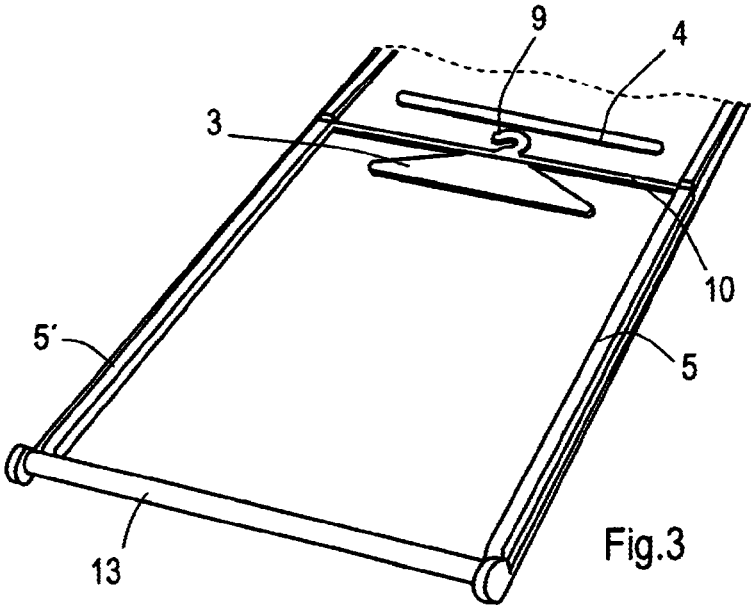
FIG. 3 shows a third embodiment of the invention.

FIG. 2 shows an embodiment almost identical to the embodiment shown in FIG. 1, only differing in that it additionally comprises a covering sheet 12 attached to the main sheet 2, in the shape of a thin transparent plastic sheet. The covering sheet 12 covers, when it is folded over the main sheet 2, one part of the front side of the main sheet 2, viz. one of the two parts meant for one piece of garment, as separated by the folding line coinciding with the edge 10.

Figure 5:
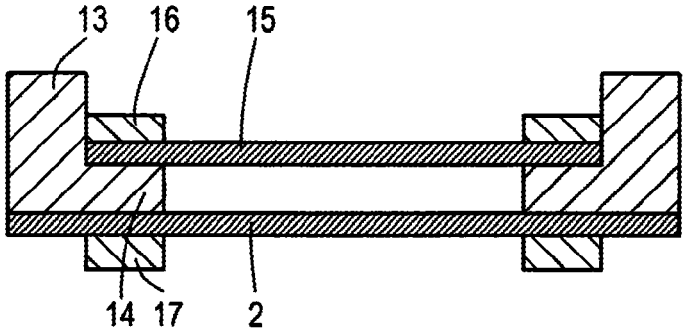
FIG. 5 shows schematically, not drawn to scale, a cross-section over a fourth embodiment of the invention, provided with a flap having rims.

In FIG. 5, in a fourth embodiment of the invention, each of the elongated elevated zones of the main sheet has a higher elongated part 13 and a lower elongated part 14, wherein each higher part faces the edge to which it is closest. The covering sheet or flap 15 has two elevated rims 16 on the side thereof facing away from the main sheet 2 and positioned on the lower parts 13 of the elongated elevated zones of the main sheet 2, when the device is rolled up. Not shown, is a hanger attached to the flap, on the same side thereof as the rims 16. In this embodiment, two pieces of clothing can be stored inside the device, in separate compartments, when the device is rolled up.

Relief zones 17 are attached to the rear side of the main sheet 2. They rest on the rims 16 when the device is in the rolled up state.

Due to the presence of push buttons (not shown) at the edges of the flap 15, the flap is detachable from the main sheet 2 and can be fitted upside down, i.e. with its rims 16 facing the main sheet, in the unrolled state of the device, in order to provide a single, larger compartment instead of two smaller ones.

In this embodiment, the flap 15 is made of stretchable material, which enhances anti-crease effect of the device.

It is noted that the rims 16 may also be omitted, while increasing the height of the relief zones 17. In this manner, the flap 15 is no longer reinforced by the rims, but this function may be taken over by e.g. push buttons by which the flap is attached to the lower elevated parts 14, in particular when stretch material is used for the flap 15.

The three illustrated embodiments may also comprise means for automatically rolling up, or stretching, the main sheet 2. These means may be integrated with the elevated zones 5, 5' and/or the relief zones 6, 6'. Such means are known per se, they are for instance applied in artificial satellites for unrolling RF-antennas and also in bracelets.

Variants can be made to the embodiments shown, without leaving the scope of the claims. For example, the main sheet may be made of bamboo rods arranged parallel to the axis of symmetry of the rolled product. Moreover, the elongated elevated zones and relief zones may be somewhat compressible and may have heights that vary in the rolling direction of the main sheet.

The invention claimed is:

1. A garment holding device comprising a main sheet of material rollable in a rolling direction and at least one cloth attachment means attached to said main sheet, wherein the main sheet is provided with at least two elongated elevated zones on the front side of the main sheet, essentially mutually parallel arranged at or near the edges of said main sheet and parallel to said rolling direction;

wherein the at least two elongated elevated zones coact with the main sheet to form a curved spacing in a rolled configuration.

2. The garment holding device according to claim 1, in which said main sheet is bendable at a plurality of bending lines, each bending line being arranged essentially perpendicular to said rolling direction.

3. The garment holding device according to claim 1, in which said main sheet is continuously bendable in said rolling direction.

4. The garment holding device according to claim 1, in which said main sheet has in a direction perpendicular to the rolling direction, over at least a part of its length in the rolling direction, a rigidity that is sufficiently high to take up an external radial point load of 25-35 N on the outside of the main sheet when said main sheet is in a rolled up state, without deformation of more than 10 mm of each point on the surface area.

5. The garment holding device according to claim 1, in which said main sheet has in a direction perpendicular to the rolling direction, over at least a part of its length in the rolling direction, a rigidity that is sufficiently high to take up an external radial load of 210-270 N equally distributed over a surface area that spans the outside length of the main sheet when said main sheet is in a rolled up state, without deformation of more than 10 mm of each point on the surface area.

6. The garment holding device according to claim 1, the main sheet is provided with at least two relief zones on the back side of the main sheet, at locations opposing said at least two elongated zones on the front side of the main sheet, which relief zones cooperate during the rolling up with the at least two elongated zones in guiding said rolling up.

7. The garment holding device according to claim 6, wherein at least one of the elongated elevated zones and its accompanying relief zone have cross-sectional shapes having at least one protrusion respectively scoring, or vice versa, wherein the scoring is suited to accommodate said protrusion.

8. The garment holding device according to claim 6, in which at least one of the elongated elevated zones and relief zones is provided with recesses in the direction perpendicular to the direction of rolling, for example V-shaped or rectangular shaped.

9. The garment holding device according to claim 6, in which at least one of the elongated elevated zones and relief zones is inflatable.

10. The garment holding device according to claim 1, wherein the at least one cloth attachment means is a clothes hanger that is flexible in the direction of rolling of the device.

11. The garment holding device according to claim 10, comprising a hook suitable for carrying the device in unrolled shape, wherein the hook is integrated with or attached to a clothes attachment means.

12. The garment holding device according to claim 1, comprising two clothes attachment means attached to the front side of the main sheet, and a folding line in the main sheet between and parallel to said two clothes attachment means as well as a hook attached to the main sheet between said two clothes attachment means or to a clothes attachment means.

13. The garment holding device according to claim 1, comprising a covering sheet attached to the main sheet, which covering sheet is suited to cover at least part of the front side of the main sheet and to uncover the main sheet by folding the covering sheet away and/or by temporarily releasing at least part of the attachment of the covering sheet to the main sheet.

14. The garment holding device according to claim 13, wherein each of the elongated elevated zones of the main sheet has a higher elongated part and a lower elongated part, wherein each higher part faces the edge to which it is closest, and, when the covering sheet is covering the main sheet, it is positioned over the lower parts of the elongated elevated zones of the main sheet.

15. The garment holding device according to claim 14, wherein the relief zones lie over the lower elongated elevated parts when the device is in the rolled up state.

* * * * *